United States Patent [19]

Inoue et al.

[11] Patent Number: 5,016,584

[45] Date of Patent: May 21, 1991

[54] ENGINE BLOCK CONSTRUCTION WITH SKELETAL FRAME

[75] Inventors: Kazuo Inoue; Tsuneo Konno; Takashi Moriya; Naomi Warashina; Masaki Ueyama; Toshinobu Hata; Kenji Hamabe; Tomoyoshi Matsuno; Hiroo Shimada; Tetsuo Gotou; Morimasa Nagata, all of Saitama, Japan

[73] Assignee: Honda Giken Kogyo Kabushiki Kaisha, Tokyo, Japan

[21] Appl. No.: 418,853

[22] Filed: Oct. 10, 1989

[30] Foreign Application Priority Data

Oct. 11, 1988 [JP] Japan ..... 63-255623
Oct. 28, 1988 [JP] Japan ..... 63-272409

[51] Int. Cl.[5] ..... F02F 7/00
[52] U.S. Cl. ..... 123/195 R; 123/195 S
[58] Field of Search ..... 123/195 R, 195 C, 195 S, 123/195 H

[56] References Cited

U.S. PATENT DOCUMENTS

| | | | |
|---|---|---|---|
| 2,334,731 | 11/1943 | Szekely | 123/41.29 |
| 4,369,744 | 1/1983 | Kubozuka et al. | 123/198 E |
| 4,753,201 | 6/1988 | Fukuo et al. | 123/195 C |

FOREIGN PATENT DOCUMENTS

| | | | |
|---|---|---|---|
| 0038560 | 4/1981 | European Pat. Off. . | |
| 0067890 | 6/1981 | European Pat. Off. . | |
| 59552 | 6/1982 | Japan . | |
| 146355 | 4/1931 | Switzerland | 123/195 R |
| 336929 | 10/1930 | United Kingdom | 123/195 R |
| 2003250 | 3/1979 | United Kingdom | 123/195 C |
| 2147662 | 10/1984 | United Kingdom . | |

*Primary Examiner*—Noah P. Kamen
*Attorney, Agent, or Firm*—Lyon & Lyon

[57] ABSTRACT

A cylinder block as a main part of an engine block includes a cylinder barrel assembly block, a skeleton-like frame surrounding the outer periphery of the cylinder barrel assembly block and a plate-like rigid film member, within a fluid passage in the skeleton-like frame. The skeleton-like frame is integrally joined to the outer surfaces of left and right side walls of the assembly block along the crankshaft axis and includes cross-beam bone members, longitudinal beam bone members and post bone members which are rigid and unitarily assembled into a three-dimensional latticework structure. A cylinder head is integrally coupled to the deck surface of the cylinder block and a lower case is integrally coupled to the lower surface of the cylinder block, lateral outer surfaces of the block and lower case along the crankshaft axis being formed flush with each other in parallel with the cylinder bore axis. The lower case includes a lower case frame of three-dimensional latticework structure and rigid film members at least on the lateral outer surfaces of the lower case frame along the crankshaft axis. Moreover, the lower case is secured to the lower surface of the cylinder block by bolts and an oil pan is floatingly carried on the lower surface of the lower case via resilient members. The cylinder block has at its one end surface along the crankshaft axis a square, transmission mating surface and a divergent bulged portion extending from a rear part of the cylinder block toward the mating surface.

30 Claims, 10 Drawing Sheets

ENGINE BLOCK CONSTRUCTION WITH SKELETAL FRAME

BACKGROUND OF THE INVENTION

1. Field of the Invention

The present invention relates to engine blocks.

2. Description of the Prior Art

An engine has been heretofore well known in which vibration proof panels are mounted on a cylinder jacket side member and a crankcase side member to form a rectangular parallelopiped cylinder block so as to reduce noises without lowering the strength of the cylinder block (see Japanese Utility Model Publication No. 43486/1984).

With the recent trend of higher rotation and higher output of the engine, measures for reducing vibrations and noises thereof pose a significant task.

It is considered that the engine gives rise to vertical bending forces, longitudinal bending forces, torsion or the like, which are synergistically magnified to generate large vibrations and noises. Most of vibrations and noises of the engine are propagated to other portions through the cylinder block portion of the engine and the bearing portions of the crankshaft. It is most important to enhance the rigidity of these parts in order to reduce the vibrations and noises. However, in the aforesaid conventional engine, no measure has been taken to enhance the rigidity of the cylinder block portion. In view of the foregoing, it is contemplated that in order to enhance the rigidity of the engine, the engine block which is a vibration generating source, particularly, its cylinder block portion, is merely increased in wall thickness, reinforced by a reinforcing member such as a stiffener or formed of a high strength material. This proposal however gives rise to another inconvenience such that the weight of the engine itself is increased, the cost is considerably increased and the like.

An engine block has been known in which measures have been taken for enhancing the rigidity of the bearing portion of said cranshaft (see Japanese Patent Publication No. 202349/1983). In this proposal, no measure for lighter weight and lower cost has not been taken.

Furthermore, a vehicular engine has been known in which a lower frame is joined to the lower surface of a cylinder block by means of bolts, a crankshaft is rotatably carried between the joined surfaces thereof, and an oil pan is fixedly mounted on the lower surface of the lower frame by means of further bolts (see U.S. Pat. No. 4,753,201 specification). However, in such an engine as described above, the cylinder block and the lower frame, and the lower frame and the oil pan are respectively directly fixed together by separate bolts. A further task arises such that an increase in weight and an increase in cost result due to the increase in the number of bolts, and in addition, since the lower frame and the oil pan are directly fixed, the vibration of the engine generated during operation is transmitted from the lower frame to the oil pan, and the noise is promoted by the vibration of the oil pan itself.

Furthermore, the vibration of the engine during operation is also transmitted to the joined surfaces between the cylinder block and the transmission case through the cylinder block. Insufficient rigidity at the joined surfaces causes the vibration and noise to be increased, and therefore the coupling rigidity of the joined surfaces between the cylinder block and the transmission case is desired to be enhanced as a further measure for reducing the vibration and noise of the engine. This measure may not yet provide a satisfactory result in the conventional structure.

Moreover, in the conventional cylinder block, a solid cylinder barrel wall surrounding a cylinder bore is formed with fluid passages such as a lubricating oil passage, a cooling water passage and the like (see Japanese Patent Publication Nos. 27526/1988 and 37246/1988).

However, in the conventional engines as described above, since there naturally involves a limitation in that the cylinder barrel wall surrounding the cylinder bore is formed with the aforesaid fluid passages, most of the fluid passages are composed of a group of pipes separate from the cylinder block. Therefore, there poses a further task in that not only the number of parts increases to increase the cost but also, since the group of pipes are overhung on the cylinder block, they vibrate to promote the vibration and noise of the engine itself.

SUMMARY OF THE INVENTION

The present invention has been accomplished in view of the above-described actual situation. It is an object of the present invention to provide an engine block which is intended for simplification of the structure resulting from reduction in number of parts and reduction in vibrations and noises of the engine.

It is a further object of the present invention to provide an engine block which is designed to have the rigidity enhanced to the maxiumum while suppressing an increase in weight of the engine to the minimum by cooperation between a skeleton-like frame which principally has a function as a strengthening member and a rigid film member which principally has a function as a rigid member.

It is another object of the present invention to provide an engine block which is designed to have a lighter weight and lower cost of the engine block as compared with conventional blocks while considerably enhancing the rigidity of the engine block, particularly of the bearing portions of a crankshaft thereof.

It is still another object of the present invention to provide an engine block which is designed to reduce the number of mounting bolts for a lower case and an oil pan to a cylinder block to suppress an increase in weight and an increase in cost of the engine and reduce noises caused by vibrations of the oil pan.

For achieving the aforesaid objects, according to the present invention, there is proposed an engine block comprising a cylinder block which constitutes a main part of an engine block and which includes a cylinder barrel assembly block, a skeleton-like frame surrounding the outer periphery of the cylinder barrel assembly block integrally therewith and a plate-like rigid film member provided on the external surface of the skeleton-like frame, wherein a fluid passage is disposed in the skeleton-like frame.

According to the present invention, there is further proposed an engine block comprising a cylinder block which constitutes a main part of an engine block and which includes a cylinder barrel assembly block having a plurality of cylinder barrels with cylinder bores provided therein, a skeleton-like frame integrally joined to the outer surfaces of left and right side walls of the cylinder barrel assembly block along the axis of a crankshaft, and a plate-like film member integrally provided on the outer surface of the skeleton-like frame, said skeleton-like frame comprising a plurality of crossbeam bone members, longitudinal beam bone members and post bone members which have rigidity and are unitarily assembled into a three-dimensinal latticework structure.

According to the present invention, there is proposed an engine block comprising a cylinder block, a cylinder head superposed and integrally coupled to the deck surface of the cylinder block and a lower case integrally coupled to the lower surface of the cylinder block, said cylinder block comprising a cylinder barrel assembly block having a plurality of cylinder barrels with cylinder bores provided therein, a skeleton-like frame in the form of a three-dimensional lattice-work structure integrally joined to the outer surfaces of left and right side walls of the assembly block along the axis of a crankshaft and a plate-like rigid film member integrally provided on the left and right outer surfaces of the skeleton-like frame, the lateral outer surfaces of the cylinder block and the lower case extening along the crankshaft axis being formed flush with each other in parallel with the cylinder bore axis.

Furthermore, according to the present invention, there is proposed an engine block wherein a lower case is integrally joined to the lower surface of a cylinder block having a cylinder barrel in which a piston is slidably fitted, and a crankshaft connected to said piston is rotatably carried between the joined surfaces of the lower case and the cylinder block, said lower case comprising a lower case frame of three-dimensional latticework structure and rigid film members disposed at least on the lateral outer surfaces of the lower case frame along the cranshaft axis, said lower case frame comprising a plurality of crossbeam bone members each having in a central portion thereof a bearing cap portion for a crankshaft and extending laterally in a direction substantially perpendicularly intersecting the crankshaft axis, a plurality of longitudinal beam bone members for integrally coupling the outer ends of the crossbeam bone members in a direction of the crankshaft axis, and a plurality of post bone members for integrally connecting the outer ends of the crossbeam bone members in a direction of the piston stroke, said rigid film members being provided on the outer surfaces of the longitudinal bone members and the post bone members.

Moreover, according to the present invention, there is proposed an engine block wherein a lower case is joined to a cylinder block, and a crankshaft is rotatably carried between the joined surfaces of the lower case and the cylinder block, and with use of a plurality of oil pan-mounting bolts, the lower case is tightened and secured to the lower surface of the cylinder block and an oil pan is floatingly carried on the lower surface of the lower case via resilient members.

Moreover, according to the present invention, there is proposed an engine block wherein a cylinder block which constitutes a main part of the engine block is formed of a cylinder barrel assembly block having a plurality of cylinder barrels with cylinder bores provided therein, a skeleton-like frame of three-dimensional latticework structure integrally joined to the outer surfaces of left and right side walls of the cylinder barrel assembly block extending along the axis of a crankshaft, and a plate-like film member integrally provided on the outer surface of the skeleton-like frame, said cylinder block having at its one end surface along the crankshaft axis a square transmission mating surface, left and right side surfaces of the cylinder block extending along the crankshaft axis being straight in the direction of the cylinder bore axis, said cylinder block having a divergent bulged portion which extends at a rear part of the cylinder block in a fan-shape toward the transmission mating surface.

According to the above-described structures, the cylinder block of the engine is formed from the cylinder barrel assembly block, the skeleton-like frame and the rigid film member whereby the bending and torsional rigidity can be enhanced. The skeleton-like frame having a function as a strengthening member is utilized to form a fluid passage whereby the whole fluid passage structure can be simplified. The number of parts can be reduced to considerably reduce cost. Furthermore, the overhanging portion of the fluid passage from the cylinder block can be reduced. The rigidity of the engine block itself is enhanced, and vibration and noise of the engine are remarkably reduced.

Furthermore, since the cylinder block which acts as a vibration source of the engine is formed so as to have a skeleton-like frame of three-dimensional latticework structure, the rigidity against the bending forces acting on the engine in vertical and longitudinal directions and against the torsion acting around the crankshaft is considerably enhanced, and the weight of the engine per unit volume is also considerably reduced. In addition, the manufacturing is easy.

In addition, the lower case is coupled to the lower surface of the cylinder block and the lateral outer surfaces of the cylinder block and the lower case extending along the crankshaft axis are formed flush with each other in parallel with the cylinder bore axis whereby high rigidity against the bending forces acting vertically and longitudinally on the coupled body of the cylinder block and the lower case and the torsion acting around the crankshaft is secured and at the same time, its weight can be reduced and the manufacturing cost can be reduced.

Moreover, the lower case comprising a lower case frame of three-dimensional latticework structure and rigid film members is joined to the lower surface of the cylinder block whereby the rigidity of the engine block itself can be considerably enhanced. The crankshaft subjected to an excessively large explosion load of the engine is firmly supported on the cylinder block and the lower case to suppress the bending and torsional forces acting on the engine block itself and considerably reduce vibration and noise of the engine. Furthermore, the weight of the lower case per unit volume is extremely low, thus contributing to lightening the weight of the engine block. The manufacturing is easy and accomplished at less cost.

Moreover, the cylinder block and the lower case are integrally coupled together by means of a plurality of fastening bolts and oil-pan mounting bolts, and the coupled body has a rectangular parallelopiped shape of high rigidity. Deformation of the coupled body due to vertical and longitudinal bending forces and the torsion around the crankshaft is suppressed. Since the lower case and the oil pan are fastened to the cylinder block by the oil-pan mounting bolts, the tightening work becomes easy and the number of bolts can be reduced. In addition, the vibration of a coupled body of the cylinder block and the cylinder head is damped and absorbed by a plurality of resilient members to reduce the transmission thereof to the oil pan.

Furthermore, the weight of the entire structure is reduced and the rigidity against bending and torsional forces is considerably enhanced by the skeleton-like frame of three-dimensional latticework structure and the plate-like rigid film member, and at the same time the transmission mating surface is formed into a square shape having a large area, and the coupling strength with the transmission is considerably enhanced.

The above and other objects, features and advantages of the present invention will become clear from the ensuing detailed description of a preferred embodiment in connection with the accompanying drawings.

BRIEF DESCRIPTION OF THE DRAWINGS

The drawings show one embodiment of an engine block according to the present invention.

DESCRIPTION OF THE PREFERRED EMBODIMENTS

Figure 1:
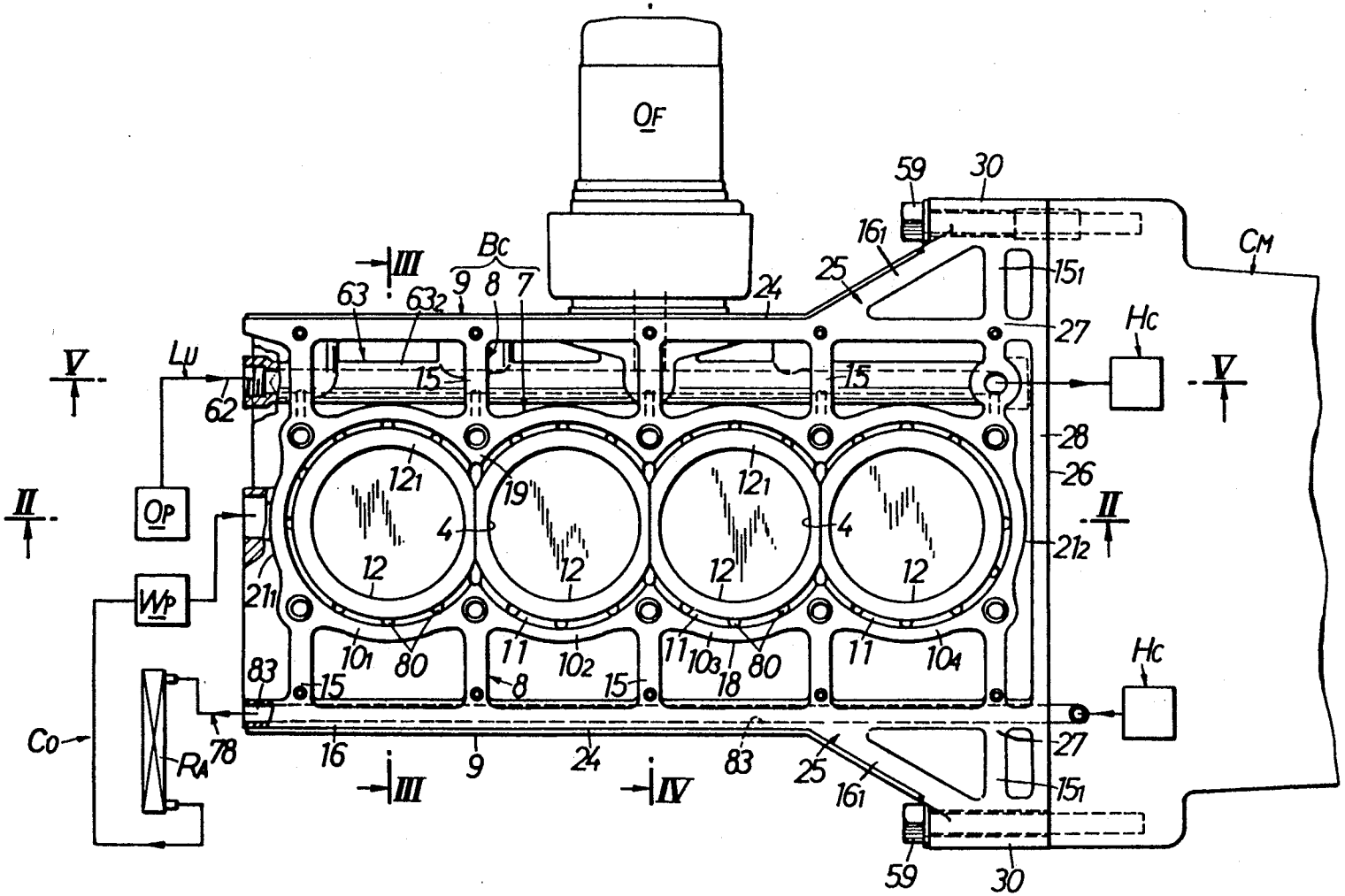
FIG. 1 is a plan view of a cylinder block of the engine taken on line I—I of FIG. 3.

One embodiment of the present invention will be described hereinafter with reference to the drawings.

FIGS. 1 to 4 show an engine block of an in-line type four-cylinder engine. In these Figures, an engine block E of the engine according to the present embodiment comprises a cylinder block Bc, a cylinder head Hc joined to a deck surface 1 through a gasket 2, and a lower case $C_L$ coupled to the lower surface of the cylinder block Bc. A head cover $C_H$ is placed over the upper surface of the cylinder head Hc, and an oil pan Po is joined to the lower surface of the lower case $C_L$ through a packing P. A crankshaft 3 is rotatably carried on the mating surfaces of the cylinder block Bc and the lower case $C_L$, and pistons 5 are slidably fitted in cylinder bores 4, respectively, of first to fourth cylinder barrels $\mathbf{10}_1$ to $\mathbf{10}_4$, the pistons 5 are connected to the crankshaft 3 through connecting rods 6.

The construction of the cylinder block Bc will be described hereinafter principally referring to FIGS. 1 to 4 as well as to FIGS. 5, 6 and 8.

Figure 5:
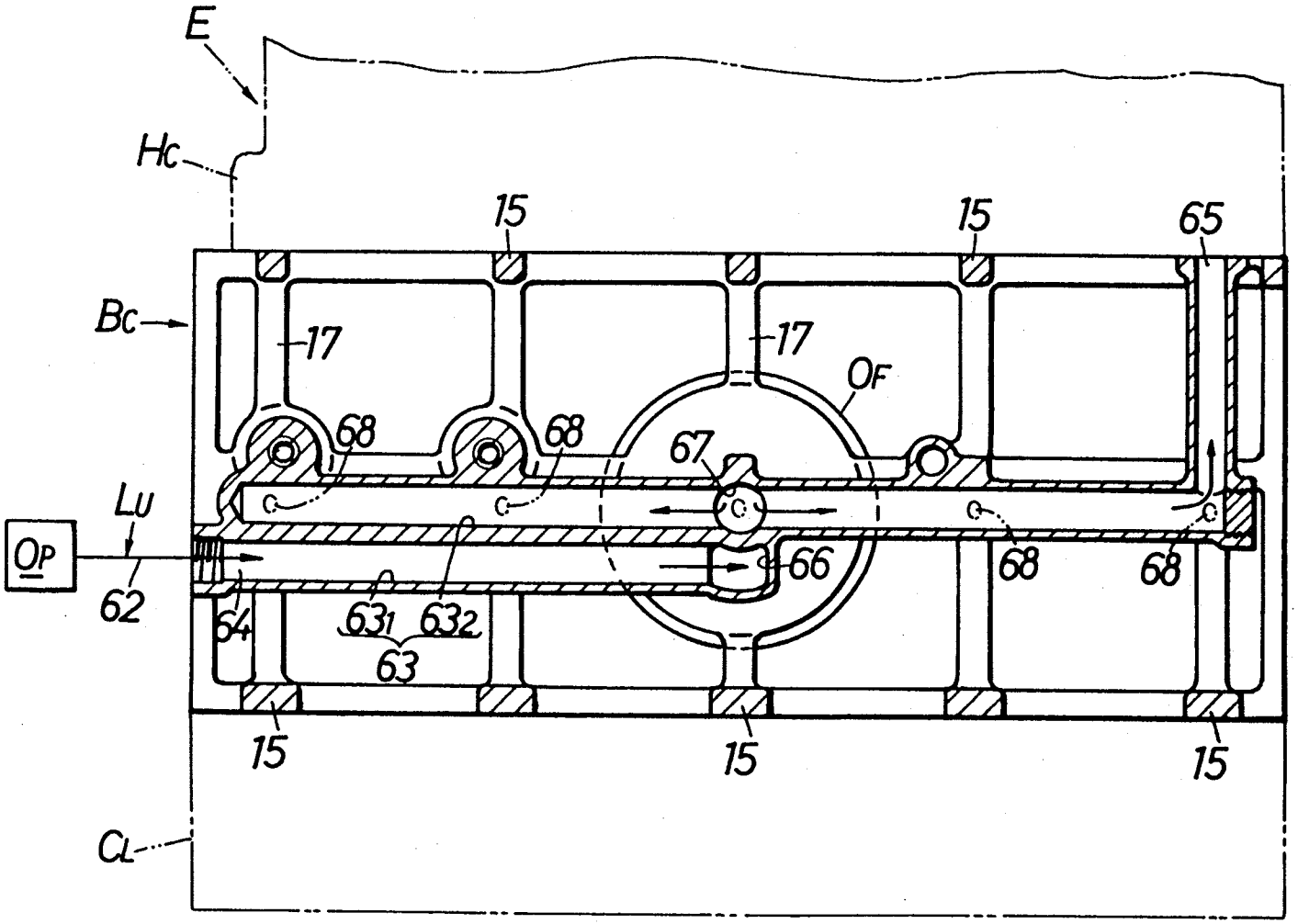
FIG. 5 is a sectional view of the cylinder block taken on line V—V of FIG. 1.
Figure 6:
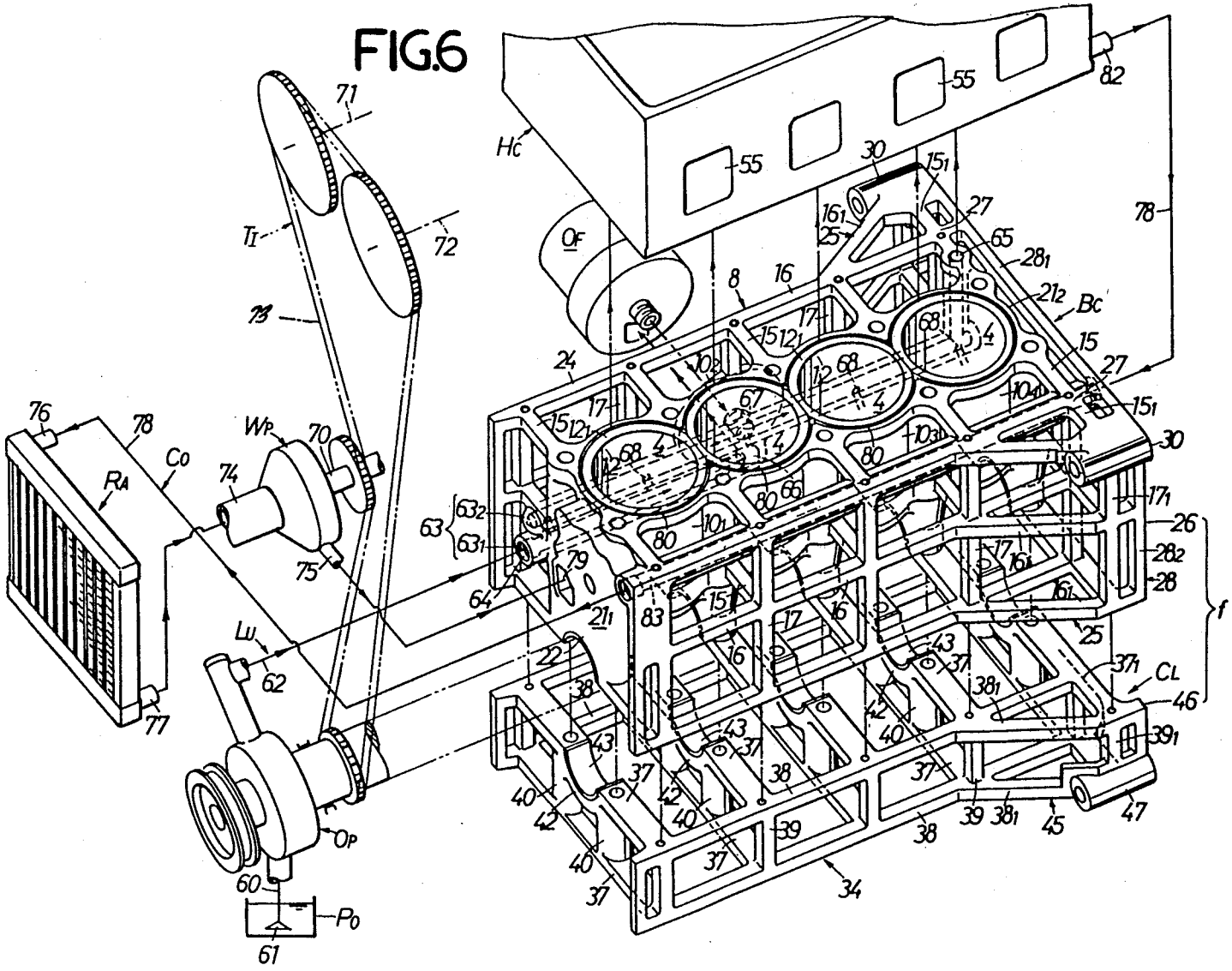
FIG. 6 is a perspective view of a lubricating system and a cooling system of the engine.
Figure 8:
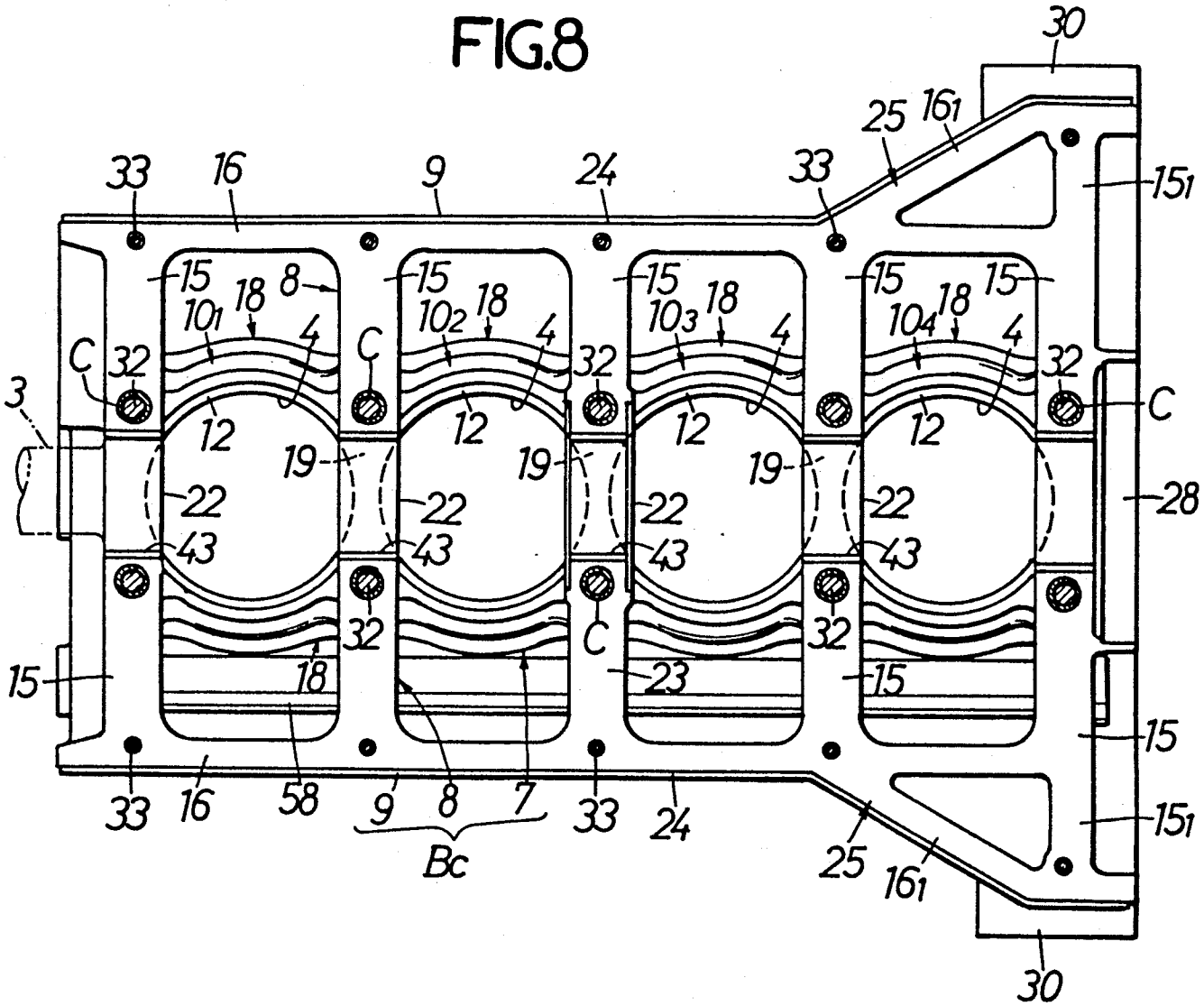
FIG. 8 is a bottom view of the cylinder block taken on line VIII—VIII of FIG. 3.

FIG. 5 is a longitudinal sectional view taken on line V—V of FIG. 1 showing a lubricating oil passage, FIG. 6 is a perspective view of a skeleton-like frame of the engine block E which will be described later, and FIG. 8 is a bottom view of the cylinder block Bc.

The cylinder block Bc is integrally molded by casting Fe or light alloy material such as $Al_1$ or Mg alloys except a rigid film member 9 which will be described later in detail, the whole cylinder block Bc having a rectangular parallelopiped shape as shown in FIG. 6. The cylinder block Bc is integrally formed from three components, i.e., a cylinder barrel assembly block 7, a skeleton-like frame 8 and a rigid film member 9 (FIG. 7) so as to have light weight, high strength and high rigidity.

The cylinder barrel assembly block 7 forms the core which constitutes a main strengthening member of the cylinder block Bc and is formed to be a unitary body having first to fourth cylinder barrels $\mathbf{10}_1$ to $\mathbf{10}_4$ arranged in a row. The first to fourth cylinder barrels $\mathbf{10}_1$ to $\mathbf{10}_4$ are formed with cylindrical hollow portions 11, respectively, and boundary portions between the adjacent hollow portions 11 and 11 are communicated with each other. A cylinder linear having an outward flange portion $\mathbf{12}_1$ at the upper end thereof, i.e., a wet liner 12 is inserted into and attached to each of the hollow portions 11 to thereby form the cylinder bore 4 having a cylinder axis $l_1$ to $l_1$ perpendicular to the first to fourth cylinder barrels $\mathbf{10}_1$ to $\mathbf{10}_4$, respectively. Front and rear end walls $\mathbf{21}_1$ and $\mathbf{21}_2$ of the cylinder barrel assembly block 7 and adjacent boundary walls 19 of the first to fourth cylinder barrels $\mathbf{10}_1$ to $\mathbf{10}_4$ are formed to be thick so as to secure high strength to the cylinder barrel assembly block 7 itself. The piston 5 is slidably fitted in the cylinder bore 4 of the wet liner 12, and a water jacket 13 (FIGS. 2 and 3) is formed between the inner peripheral surface of each of the first to fourth cylinder barrels $\mathbf{10}_1$ to $\mathbf{10}_4$ and the associated wet liners 12. Water from a cooling system Co which will be described later is supplied into the water jacket 13 whereby the first to fourth cylinder barrels $\mathbf{10}_1$ to $\mathbf{10}_4$ and the wet liners 12 are forcibly cooled.

Upper half portions 22 of bearing means for carrying upper half portions of journal portions $\mathbf{3}_1$ of the crankshaft 3 are formed on the lower surfaces of front and rear thick end walls $\mathbf{21}_1$ and $\mathbf{21}_2$ located at lengthwise front and rear positions of the cylinder barrel assembly block 7 and at thick boundary walls 19 between the adjacent cylinder bores 4 of the assembly block 7.

The construction of the skeleton-like frame 8 of three-dimensional latticework structure will be described hereinafter. The skeleton-like frame 8 principally constitutes a strengthening member of the cylinder block Bc and is integrally molded from the same material as that of the assembly block 7 so as to surround the outer periphery of the cylinder barrel assembly block 7. The skeleton-like frame 8 is formed into a generally rectangular parallelopiped configuration by integrally assembling a plurality of cross-beam bone members 15 . . . , longitudinal beam bone members 16 . . . and post bone members 17 . . . into a three-dimensional latticework structure. The construction of these bone members 15 . . . , 16 . . . and 17 . . . will be further described in detail. The plurality of crossbeam bone members 15 each have a square in section and are integrally stood upright on the outer surfaces of left and right side walls 18 and 18 along the arranging direction (crankshaft axis direction $l_2$—$l_2$) of the cylinder bores 4 of the cylinder barrel assembly block 7 at substantially equal vertical spacings therebetween at locations corresponding to the front and rear end walls $\mathbf{21}_1$, $\mathbf{21}_2$ and the boundary walls 19 of the assembly block 7. The crossbeam bone members 15 are extended laterally from the cylinder barrel assembly block 7 to left and right while substantially perpendicularly intersecting the crankshaft axis $l_2$—$l_2$. The lowermost ones of the vertically spaced crossbeam bone members 15 are each formed to have a larger diameter than those of the remaining crossbeam bone members to further enhance rigidity of the lower surface of the cylinder block Bc, that is, the surface thereof (a support portion of the crankshaft 3) joined to the lower case $C_L$ which will be described later. The longitudinal beam bone members 16 and the post bone members 17 which are square in section and form in cooperation an integral latticework structure and which further form both side walls of the skeleton-like frame 8 extending lengthwise of the frame are integrally coupled to the outer ends of the plurality of crossbeam bone members 15. The plurality of longitudinal beam bone members 16 extend parallel with each other and lengthwise of the block 7 with substantially equal vertical spacings therebetween, and the plurality of post bone members 17 vertically extend parallel with each other with substantially equal spacings therebetween lengthwise of the cylinder barrel assembly block 7.

The skeleton-like frame 8 is thus formed by assembling the crossbeam bone members 15, longitudinal beam bone members 16 and post bone members 17 into a three-dimensional lattice-work structure whereby high bending and torsional strengths despite the light weight are secured.

The crossbeam bone members 15 and the post bone members 17 are aligned on lateral extensions of the longitudinally opposite end walls of the cylinder barrel assembly block 7 and the boundary walls 19 between the adjacent cylinder bores 4 of the assembly block 7, and serve as the strengthening members which can effectively withstand the load from the bearing structure for the crankshaft 3 which will be described later. The lateral outer surfaces along the crankshaft axis $l_2$—$l_2$ of the skeleton-like frame 8 composed of the plurality of longitudinal beam bone members 16 and post bone members 17 are formed into straight and flat surfaces extending substantially parallel with the cylinder bore axis $l_1$—$l_1$ over the full vertical length from the upper end reaching the deck surface 1 of the cylinder block Bc to the lower end reaching the joined surface 23 of the lower case $C_L$.

As shown in FIGS. 1, 6 and 8, left and right outer surfaces 24 and 24 of the skeleton-like frame 8 are integrally formed with left and right bulged portions 25 and 25, respectively, which are divergently enlarged from the rear portions thereof, that is, from the outer end portions of the crossbeam bone members 15 positioned at one boundary wall 19 between the third and fourth cylinder barrels $10_3$ and $10_4$ toward the rear end surface of the skeleton-like frame 8 whereby the rear end surface of the skeleton-like frame 8 is formed so as to have a square section area larger than that of the front end surface. The left and right bulged portions 25 are each formed into a triangular prism by extended crossbeam bone members $15_1$, $15_1$ . . . which are laterally outwardly extended from crossing portion 27 at which left and right crossbeam bone members 15, 15 positioned at the rear end surface of the skeleton-like frame 8, that is, on the side of a cylinder block side transmission mating surface 26, longitudinal beam bone members 16, 16 and post bone members 17, 17 are combined, diagonally rearwardly extending inclined longitudinal beam bone members $16_1$, $16_1$ . . . branched from those portions of the longitudinal beam bone member 16, 16 . . . corresponding to the one boundary wall 19 between the third and fourth cylinder barrels $10_3$ and $10_4$, and vertically extending outer post bone members $17_1$, $17_1$ which integrally connect the outer ends of the extended crossbeam bone members $15_1$, $15_1$ . . . and inclined longitudinal beam bone members $16_1$, $16_1$ . . . The inclined outer surfaces of the left and right bulged portions 25 and 25 in the form of a triangular prism are formed to be linear in the vertical direction, that is, parallel to the cylinder bore axis $l_1$—$l_1$ direction.

The left and right bulged portions 25 and 25 are integrally formed at the rear surface thereof with a transmission case mounting frame 28 having the mating shape with the former. The frame 28 has a lower surface-opened gate shape formed by a lateral frame $28_1$ and left and right vertical frames $28_2$ and $28_2$, and the rear surface thereof is formed into the cylinder block side transmission mating surface 26.

As described above, the cylinder block side transmission mating surface 26 at the rear end surface of the cylinder block Bc has a square shape, and a lateral span thereof perpendicularly intersecting the crankshaft axis $l_2$—$l_2$ is enlarged to enhance the bending and torsinal rigidity of the transmission mating surface 26.

Upper edge corners of the left and right bulged portions 25 and 25 are integrally provided with longitudinally extending, tubular upper bolt inserting bosses 30 and 30 for mounting the transmission case $C_M$.

Figure 4:
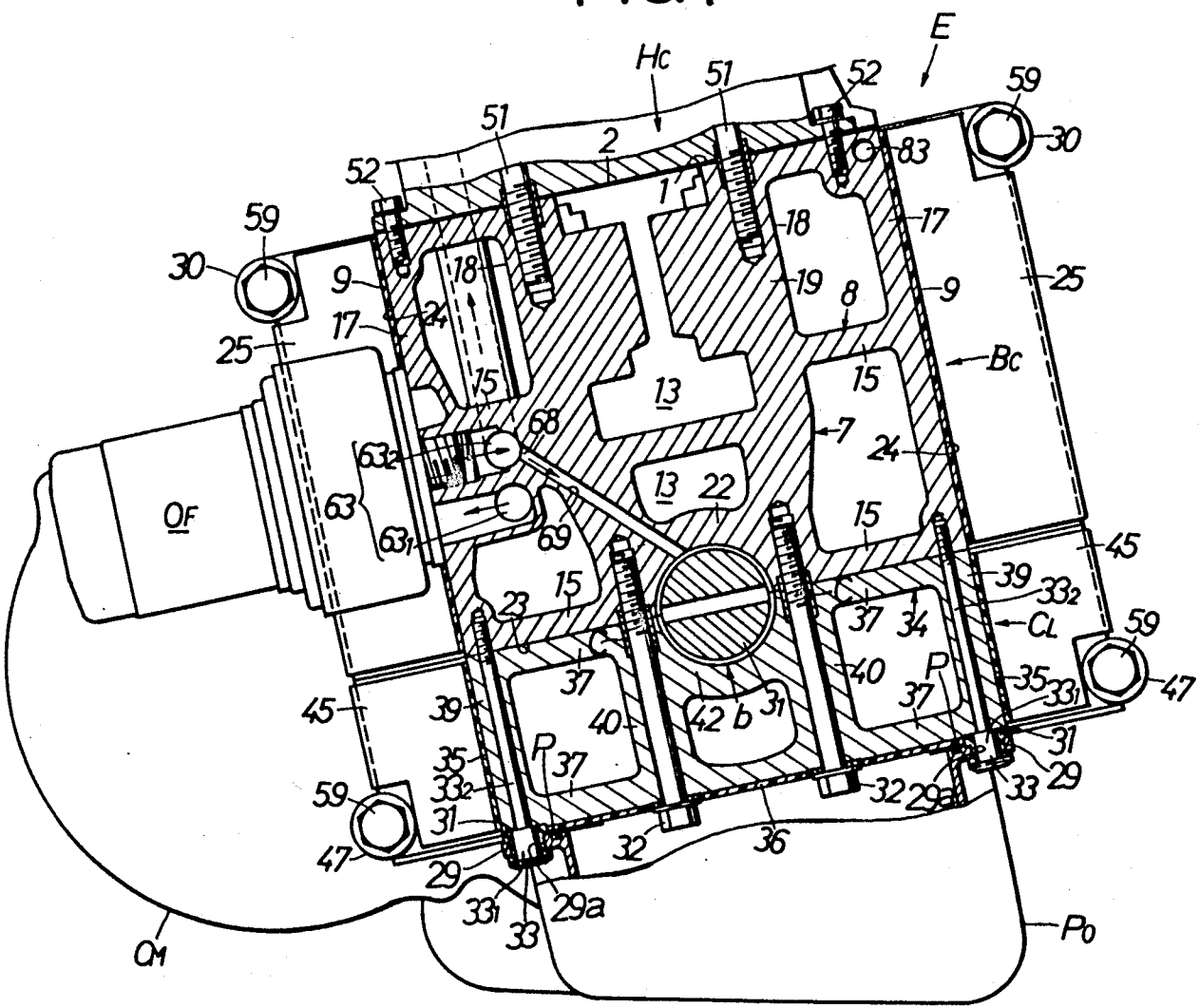
FIG. 4 is a partly enlarged sectional view of the cylinder block taken on line IV—IV of FIG. 1.
Figure 7:
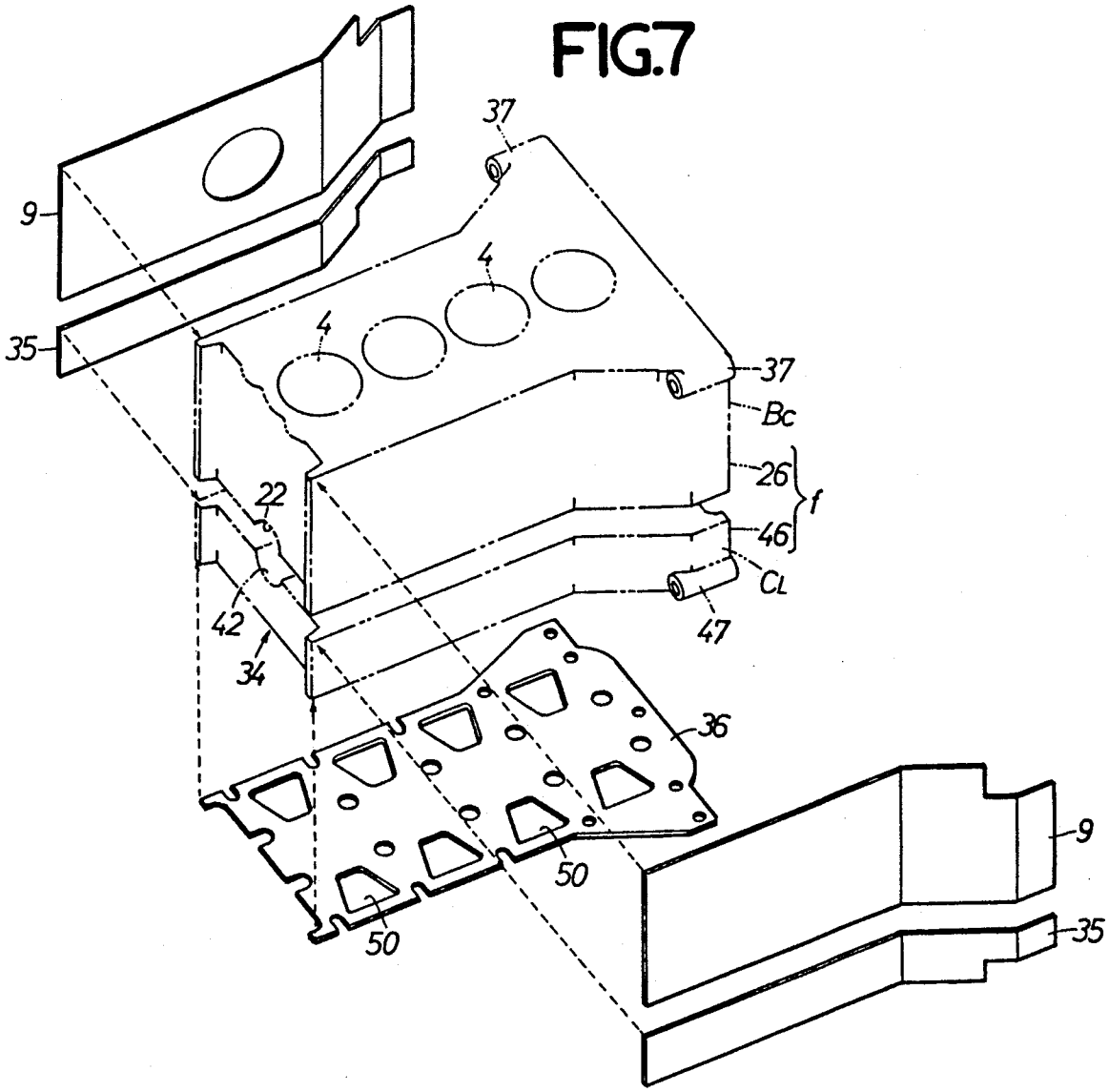
FIG. 7 is a disassembled perspective view of the cylinder block.

As shown in FIGS. 4 and 7, left and right rigid film members 9 and 9 each formed of a single metal plate such as steel plate, aluminum plate, etc. or reinforced synthetic resin plate such as FRP, FRM, etc. are directly adhered to left and right outer surfaces 24 and 24 extending straight forwardly and vertically along the cylinder bore axis $l_1$—$l_1$ of the skeleton-like frame 8, by an adhesive.

As the aforesaid adhesive, FM-300 (manufactured by American Cyanamid) containing a heat resistant epoxy group resin as a main component is used. The rear portions of the rigid film members 9 and 9 are outwardly bent so that they may be disposed along the left and right outer surfaces of the skeleton-like frame 8 as shown in FIG. 7.

The left and right outer surfaces 24 and 24 of the skeleton-like frame 8 are formed into the vertical straight surfaces whereby the rigid film members 9 and 9 can be also formed by plates each having a vertical straight surface, facilitating its manufacture thereof as a high rigid and vibration suppressing material. Since the rigid film member 9 is made straight substantially parallel with the cylinder bore axis $l_1$—$l_1$, it receives, principally as a shearing stress, the bending acting on the cylinder block Bc and torsional vibration around the crankshaft 3.

It is noted that the rigid film member 9 may be molded by casting or the like integrally with the skeleton-like frame 8. Further, the rigid film member 9 may be divided into two front and rear sheets at the bent portion on the outer surface of the skeleton-like frame 8, that is, at the base end of the bulged portion 25. In this way, the divided rigid film members 9 can be formed from a single flat plate to further facilitate the manufacture thereof.

As shown in FIG. 4, the lower case $C_L$ is fixedly mounted on the lower surface of the cylinder block Bc by means of a plurality of connecting bolts 32 and oil pan-mounting bolts 33.

The construction of the lower case $C_L$ will be described hereinafter with reference to FIGS. 1 to 4, 6, 7, 9 and 10. The lower case $C_L$ comprises a lower case frame 34 of which has a three-dimensional latticework structure having the same planar shape as that of the cylinder block Bc, two rigid film members 35 and 35 directly adhered to both left and right sides the lower case frame 34 extending longitudinally thereof (the crankshaft axis $l_2$—$l_2$ direction), and a bottom plate 36 having rigidity which also serves as a baffle plate adhered to the bottom surface of the lower case frame 34.

The lower case frame 34 is constituted by assembling and connecting a plurality of crossbeam bone members 37, longitudinal beam bone members 38 and post bone members 39 into a three-dimensional latticework structure likewise the skeleton-like frame 8 of the cylinder block Bc. The plurality of crossbeam bone members 37 are laterally arranged in upper and lower two rows in a spaced relation lengthwise (crankshaft axis $l_2$—$l_2$ direction) of the lower case $C_L$, and the plurality of longitudinal beam bone members 38 and post bone members 39 are integrally coupled to both the left and right ends of the crossbeam bone members 37 longitudinally and vertically of the lower case $C_L$. When the cylinder block Bc is coupled onto the lower case $C_L$, the crossbeam bone members 37, longitudinal beam bone members 38 and post bone members 39 of the lower case $C_L$ are vertically placed in registration with the crossbeam bone members 15, longitudinal beam bone members 16 and post bone members 17 of the cylinder block $B_C$ whereby the coupled body of the cylinder block Bc and lower case $C_L$ is formed into a rectangular parallelopiped shape in which both front and rear ends and left and right sides of the engine block E are vertically straight.

Intermediate portions of the upper and lower crossbeam bone members 37 of the lower case $C_L$ are integrally joined together by a pair of reinforcing ports 40 and 40 vertically extending in a spaced relation to left and right. Each of the crossbeam bone members 37 is formed, between the reinforcing posts 40 and 40, a semicircular lower bearing half portion for carrying the lower half portion of the crankshaft 3, that is, a bearing cap portion 42.

Figure 2:
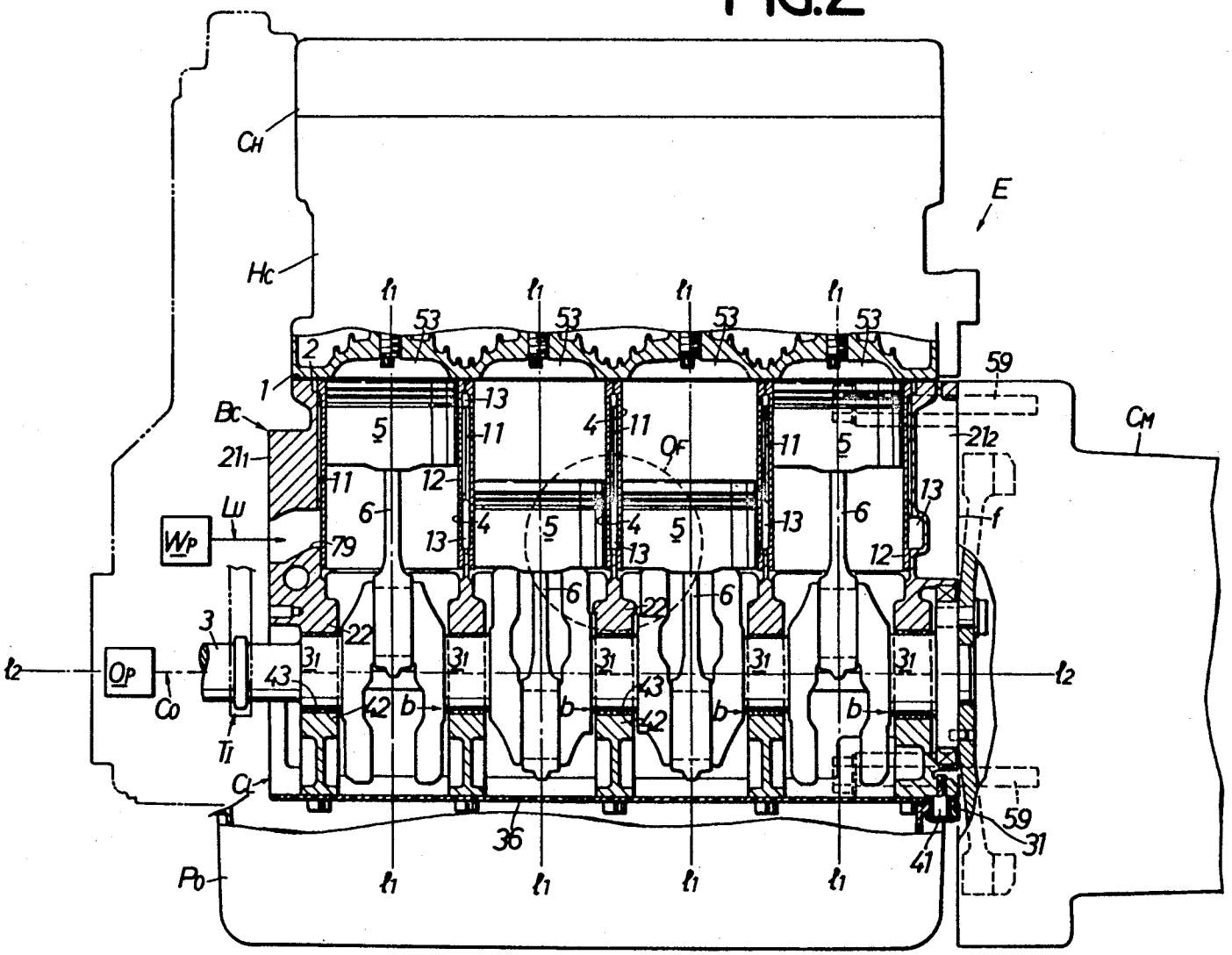
FIG. 2 is a partly sectioned side view of an engine block taken on line II—II of FIG. 1.
Figure 3:
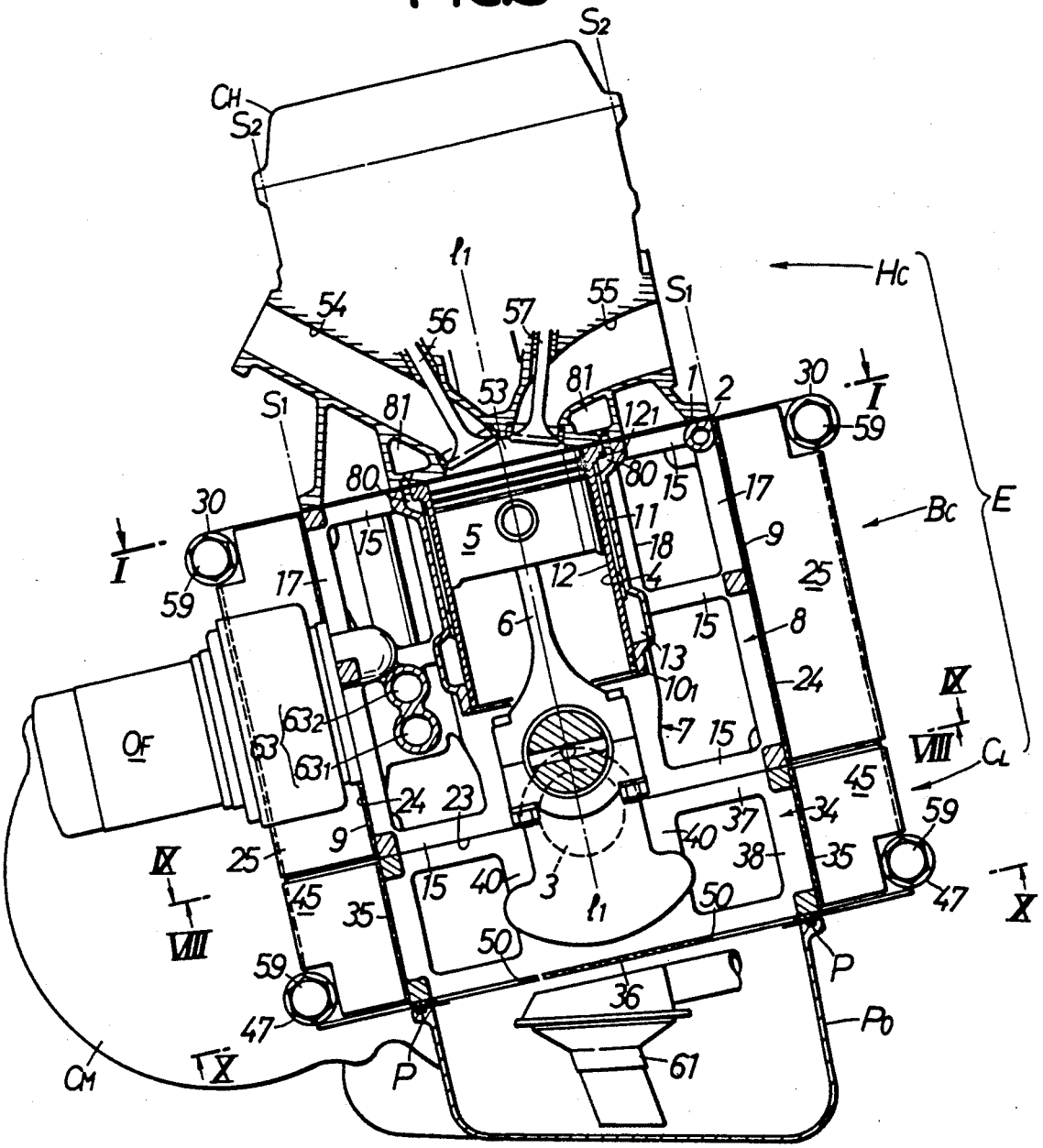
FIG. 3 is a sectional view of the engine block taken on line III—III of FIG. 1.

As shown in FIGS. 3 and 4, when the cylinder block Bc is coupled to the lower case $C_L$, the respective pairs of reinforcing posts 40 and 40 are vertically placed in registration with the front and rear end walls $21_1$, $21_2$ having a large wall-thickness and boundary walls 19 of the cylinder barrel assembly block 7 of the cylinder block Bc, and the bearing cap portions 42 are placed in registration with the upper bearing half portions 22 on the lower surface of the cylinder block Bc to constitute a plurality of bearing portions b for the crankshaft 3. Journal portions $3_1$ of the crankshaft 3 are rotatably carried by the bearing portions b through bearing metals 43 as shown in FIGS. 2 to 4.

The rear portions of both outer side surfaces of the lower case $C_L$ extending longitudinally thereof are integrally formed with bulged portions 45 divergently spread outwardly toward the rear ends thereof. The rear surface (the end on the transmission mounting side) of the lower case $C_L$ is formed to be wider than the front end surface thereof by said bulged portions 45, and the wide rear end is formed with a lower case side transmission mating surface 46 of which end shape is in the form of a depression. The lower case side transmission mating surface 46 cooperates with the transmission mating surface 26 on the cylinder block Bc to form a square-shaped transmission mating surface f, to which is coupled the transmission case $C_M$ as shown in FIG. 1.

The bulged portion 45 comprises extended crossbeam bone members $37_1$ extending from the crossbeam bone member 37 located at the rearmost end, inclined longitudinal beam bone members $38_1$ branched from the rear portion of the longitudinal beam bone members 38 and coupled to the outer ends of the extended crossbeam bone members $37_1$, and a post bone member $39_1$ for vertically connecting outer ends of the extended crossbeam bone members $37_1$, $37_1$ and longitudinal beam bone members $38_1$, $38_1$. The left and right bulged portions 45 are formed at left and right corners at the lower edges thereof with lower bolt inserting bosses 47 for coupling the transmission case $C_M$ to the lower case $C_L$. As shown in FIGS. 2 to 4, when the cylinder block Bc and the lower case $C_L$ are connected together, the bulged portions 45 of the lower case $C_L$ are formed flush with the outer surfaces of the bulged portions 25 of the cylinder block $B_c$, and their rear end surfaces are formed into a square shape of which outer peripheral edges are registered with each other, a transmission mating surface f is formed at the end surfaces of the bulged portion. The upper and lower bolt inserting bosses 30, 30, 47 and 47 are disposed at four corners of the transmission mating surface f. The joined surface of the transmission case $C_M$ is superposed to the transmission mating surface f, which are integrally connected by inserting four connecting bolts 59 into the bolt inserting bosses 30, 30, 47 and 47 and screw-engaging the bolts to the transmission case $C_M$. As just mentioned above, the connected body of the cylinder block Bc and lower case $C_L$ and the transmission case $C_M$ can be coupled to each other by only four connecting bolts 59. The coupling work is easy, contributing to a reduced weight of the whole structure.

As shown in FIGS. 3, 4 and 7, rigid film members 35 and 35 each formed from a single metal plate such as a steel plate, an aluminum plate, etc. or strengthened synthetic resin plates such as FRP, FRM, etc. are directly adhered by an adhesive to both left and right outer side surfaces which are formed as vertically straight surfaces of the lower case 34. The rigid film members 35 and 35 are formed flush with the left and right rigid film members 9 and 9 of the cylinder block Bc.

It is noted that the rigid film member 35 may be molded by casting or the like integrally with the lower case frame 34. It is further noted that the rigid film member 35 may be divided into two front and rear sheets at the bent portion of each of the left and right outer surfaces of the lower case frame 34, that is, at the base end of the bulged portion 45. In this way, each of the divided parts of the rigid film members 35 can be formed from a single flat plate without a bent portion, further facilitating the manufacture thereof.

Figure 10:
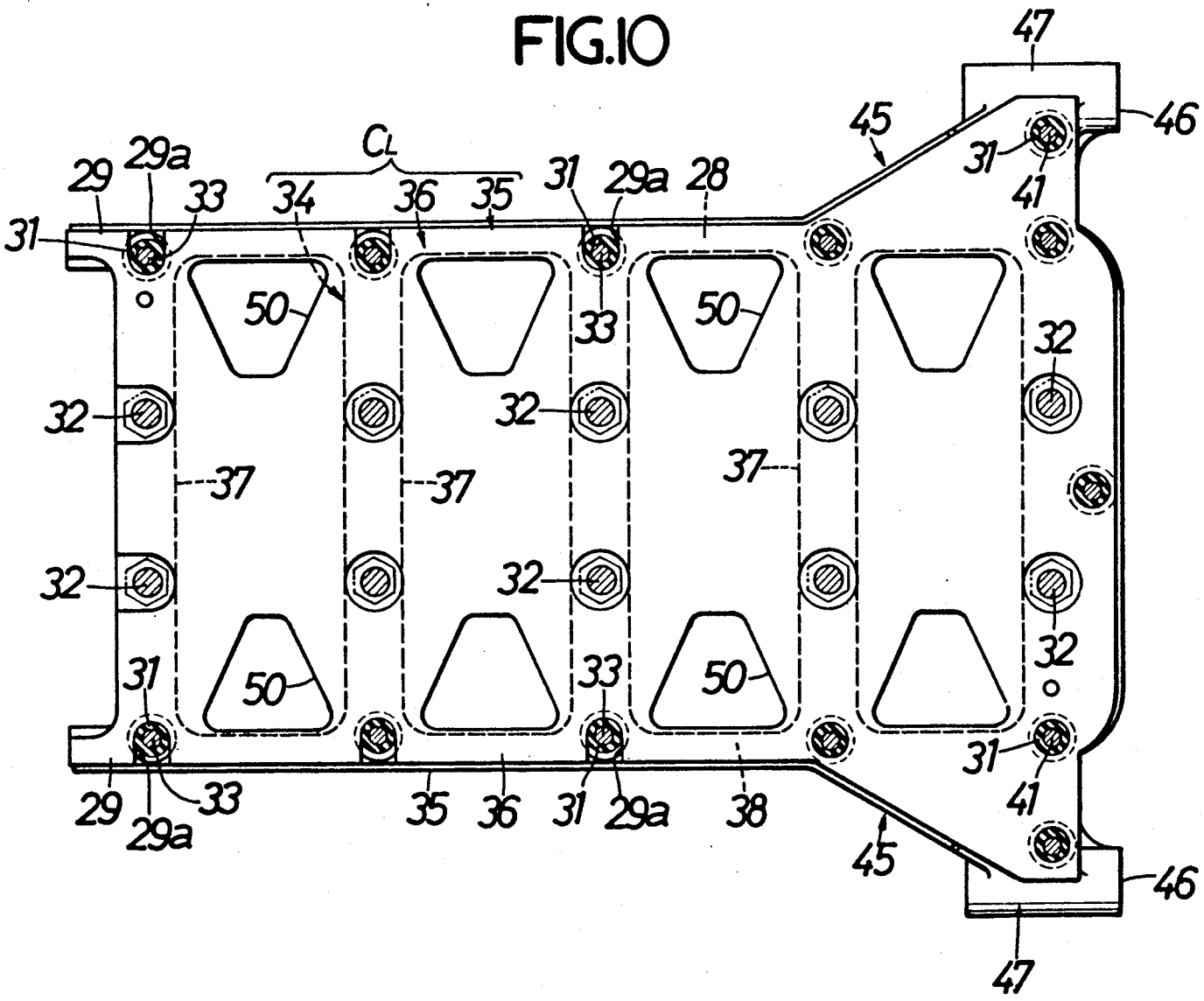
FIG. 10 is a bottom view of the lower case taken on line X—X of FIG. 3.

As shown in FIGS. 2 to 4, the bottom plate 36 as a baffle plate formed from a flat plate such as a metal plate, a plastic plate, etc. is joined by an adhesive to the flat bottom surface of the lower case $C_L$, and an oil pan Po is coupled to the lower surface of the bottom plate 36. The bottom plate 36 is bored with a plurality of oil return holes 50 as shown in FIGS. 3, 7 and 10 so that lubricating oil may flow between the cylinder block Bc and the oil pan Po through the oil holes 50.

It is noted that the bottom plate 36 may be divided into a plurality of plates.

Figure 9:
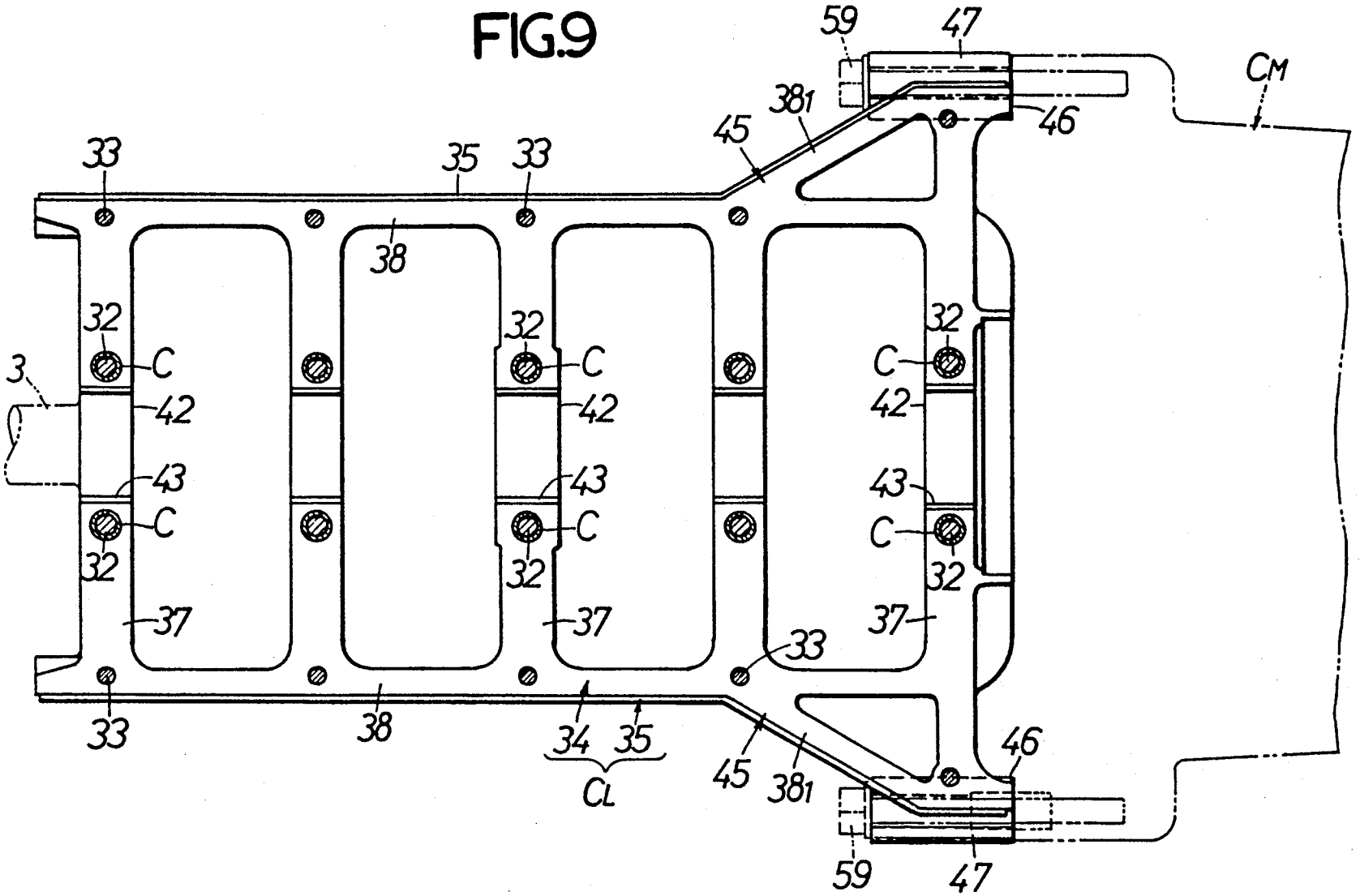
FIG. 9 is a plan view of a lower case taken on line IX—IX of FIG. 3.

As shown in FIGS. 2 to 4, the flat upper surface of the lower case $C_L$ composed of the lower case frame 34, left and right rigid film members 35, 35 and bottom plate 36 is superposed to the flat bottom surface of the rectangular parallelopiped cylinder block Bc, and the cylinder block Bc and the lower case $C_L$ are integrally connected by inserting a plurality of connecting bolts 32 into the lower case $C_L$ and screw-enagaging the bolts to the cylinder block Bc from the lower surface of the lower case $C_L$. As shown in FIGS. 4, 8 and 9, at the mating surfaces of the cylinder block Bc and the lower case $C_L$ there are provided locating collars C for locating them, said connecting bolts 32 extending through the collars C.

The oil pan Po is superposed to the flat lower surface of the lower case $C_L$, and the oil pan Po along with the lower case $C_L$ are secured together to the cylinder block Bc by means of a plurality of oil pan-mounting bolts 33. The mode of securing the oil pan Po and the lower case $C_L$ to the cylinder block Bc will be described in detail with reference to FIGS. 4 and 10. A large diameter head portion $33_1$ of the oil pan-mounting bolt 33 extends through a mounting hole 29*a* bored in a mounting flange 29 formed along outer periphery of the oil pan Po through a resilient grommet 31 as a resilient member formed of rubber, synthetic resin or the like, and a shaft portion $33_2$ thereof extends through the lower case $C_L$ and is threadedly mounted to the cylinder block bc, as shown in FIG. 4. As shown in FIG. 2, the rear end (right end) of the oil pan Po is secured to the rear end of the lower case $C_L$ by means of a short bolt 41 through resilient grommet 31.

With the above-described arrangement, the oil pan Po is floatingly carried on the lower surface of the lower case $C_L$ by the oil pan-mounting bolts 33 through the resilient grommets 31 so that vibration from the lower case $C_L$ is not easily transmitted to the oil pan Po. Moreover, since the lower case $C_L$ and the oil pan Po are tightened together to the cylinder block Bc by the oil pan-mounting bolts, not only the tightening work is simplified but also the number of bolts can be reduced.

Incidentally, the oil pan Po can be formed of any desired kind of material. The above floating structure is, however, extremely effective when the oil pan is made of a resin material such as the kind of polyamide resin, in order to prevent concentration of the tightening force of the mounting bolts 33. This floating structure is also effective when the oil pan Po is made of a sheet metal.

The cylinder block Bc and the lower case $C_L$ are connected together to define the bearing portions b at the mating surfaces therebetween, and the journal portions $3_1$ of the crankshaft 3 are rotatably carried on the bearing portions b through the bearing metals 43.

As shown in FIGS. 1 to 4, the cylinder head Hc is integrally coupled to the flat deck surface 1 of the cylinder block Bc by a plurality of long and short connecting bolts 51 and 52. As shown in FIG. 3, outer surfaces $S_2$, $S_2$ of the cylinder head Hc, which extend longitudinally that is, along the crankshaft axis $l_2$—$l_2$ are positioned inwardly of outer surfaces $S_1$, $S_1$ of the cylinder block Bc and the lower case $C_L$ extending in the same direction.

Next, a lubricating system Lu provided on the engine block E to forcibly supply lubricating oil to parts to be lubricated of the engine block E will be described with reference to FIGS. 1 to 6. As clearly shown in FIG. 6, an oil pump Op is directly connected to one end of the crankshaft 3 opposite the transmission case $C_M$. An intake port of the oil pump Op is connected through an intake passage 60 to an oil strainer 61 dipped into lubricating oil within the oil pan Po, and a discharge port of the oil pump Op is communicated through a discharge passage 62 with an oil gallery 63 which is integrally provided within the skeleton-like frame 8 of the cylinder block Bc as clearly shown in FIG. 5.

The oil gallery 63 comprises first and second oil galleries $63_1$ and $63_2$. The first oil gallery $63_1$ extends lengthwise from one end of the skeleton-like frame 8 to the central portion thereof, and has an outer end opened as an inlet 64 in communication with the discharge passage 62 and an inner end opened as an outlet 66 in communication with an inlet of an oil filter $O_F$ which will be described later. The second oil gallery $63_2$ extends substantially parallel with the first oil gallery $63_1$ over the full longitudinal length of the skeleton-like frame 8 and extends upward while being bent substantially at right angles from the rear end thereof, and an outlet 65 reaching the upper surface of the skeleton-like frame 8 is opened at the upper end of the second gallery. The outlet 65 is communicated with a lubricating-oil passage on the side of the cylinder head Hc not shown. An inlet 67 in communication with an outlet of the oil filter $O_F$ later is opened at the central portion of the second gallery $63_2$. On both left and right sides of the inlet 67, a plurality of oil ports 68 are opened in the second oil gallery $63_2$ in a spaced relation, the oil ports 68 being communicated with parts to be lubricated of the cylinder block Bc, the oil ports 68 being communicated with the bearing portions b for the crankshaft 3 through an oil passage 69 as shown in FIG. 4.

Integral formation of the oil gallery 63 composed of the first and second galleries $63_1$ and $63_2$ with the skeleton-like frame 8 contributes to enhancing the rigidity of the skeleton-like frame 8.

As shown in FIGS. 1 to 3 and 6, the oil filter $O_F$ is threadedly supported on the outer surface of the skeleton-like frame 8 of the cylinder block Bc, and its inlet and outlet are communicated with the outlet 66 of the first oil gallery $63_1$ and inlet 67 of the second oil gallery $63_2$, respectively.

When the engine is driven to rotate the crankshaft 3, the oil pump $O_P$ is driven so that lubricating oil within the oil pan Po passes through the oil strainer 61 and is then pumped up by the oil pump $O_P$. The pressurized lubricating oil from the oil pump Op is introduced into the first oil gallery $63_1$ as indicated by arrows in FIGS. 5 and 6 through the discharge passage 62. The lubricating oil flowing through the first oil gallery $63_1$ flows into the oil filter $O_F$ from the outlet 66 thereof. The lubricating oil cleaned by the oil filter $O_F$ flows into the second oil gallery $63_2$, and a part thereof passes through the oil ports 68 and is supplied to a plurality of parts to be lubricated such as the bearing portions for the crankshaft 3 in the cylinder block Bc. The lubricating oil flowing through the second oil gallery $63_2$ flows from the outlet 65 to an oil passage not shown on the side of the cylinder head Hc.

It is noted that the oil gallery 63 may be formed on the bone members themselves which constitute the skeleton-like frame 8.

Next, the construction of a cooling system Co provided on the cylinder block Bc to cool heated parts around the cylinder bores 4 of the cylinder block Bc and the like will be described with reference to principally FIGS. 1 and 6. A water pump Wp is supported on the front end wall of the cylinder block Bc, and a pump shaft 70 of the water pump Wp is operatively connected to a timing transmission belt 73 of a timing transmission mechanism $T_1$ which operatively connects the crankshaft 3 with a pair of cam shafts 71 and 72. An intake port of the water pump Wp is communicated with an outlet 77 of a radiator $R_A$ through an intake passage 74, and a discharge port thereof is communicated with an inlet 76 of the radiator $R_A$ while passing a discharge passage 75, a group of cooling-water passages formed in the cylinder block Bc and cylinder head Hc and a circulating passage 78. A front end wall $21_1$ of the cylinder barrel assembly block 7 is bored with an inlet 79 in communication with the water jacket 13 formed therein, the inlet 79 being communicated with the discharge passage 75 in communication with the discharge port of the water pump Wp. Outlets 80 of the water jacket 13 are opened to the deck surface 1 of the cylinder block Bc as shown in FIGS. 1, 3 and 6, the outlet 80 being communicated with the water jacket 81 on the side of the cylinder head Hc. The water jacket 81 has an outlet 82 opened to the rear end wall of the cylinder head Hc as shown in FIG. 6, the outlet 82 being communicated with the inlet 76 of the radiator $R_A$ through the circulating passage 78.

One longitudinal beam bone member 16 on the upper edge of the skeleton-like frame 8 of the cylinder block Bc is formed with a straight cooling-water passage 83 over the full length thereof, the passage 83 constituting a part of the circulating passage 78.

When the engine is operated, the water pump Wp is driven through the timing transmission mechanism $T_1$. Thereby, the cooling water cooled by the radiator $R_A$ is sucked and pressurized by the water pump Wp, passes through the discharge passage 75 and flows into the water jacket 13 formed in the cylinder barrel assembly block 7 of the cylinder block Bc from the inlet 79. The cooling water cools the heated parts around the cylinder bores 4 of the assembly block 7 and thereafter passes through the outlets 80 and flows into the water jacket 81 of the cylinder head Hc to cool the heated parts around the combustion chambers 53 of the cylinder head Hc, thereafter the cooling water returns to the radiator $R_A$ through the circulating passage 78. At that time, the cooling water flows through the cooling water passage 83 within one longitudinal beam bone member 16 of the skeleton-like frame 8.

In FIG. 3, reference numerals 54 and 55 designate intake and exhaust ports, respectively, formed in the cylinder head Hc, and 56 and 57 designate intake and exhaust valves, respectively, for opening and closing the ports 54 and 55.

While in the above-described embodiment, description has been made of the case where the present invention is applied to an inline type four-cylinder engine, it is to be noted of course that the invention can be applied to other types of the engine.

It is further noted that other lubricating fluid in place of the lubricating oil may be used in the lubricating system Lu, and that other coolants in place of cooling water may be used in the cooling system Co.

What is claimed is:

1. An engine block comprising a cylinder block provided with cylinder barrels with each cylinder barrel having a piston slidably fitted therein and a lower case integrally joined to a lower surface of the cylinder block, a crankshaft being operatively connected to said pistons and rotatably supported between joined surfaces of the cylinder block and the lower case, said lower case comprising a lower case frame of a three-dimensional latticework structure and rigid film members disposed at least on lateral outer side surfaces of the lower case frame extending along the crankshaft axis, said lower case frame comprising a plurality of crossbeam bone members each having a bearing cap portion in the central portion thereof for the crankshaft and laterally extending in a direction of substantially perpendicularly intersecting the crankshaft axis, a plurality of longitudinal beam bone members for integrally connecting outer ends of said cross-beam members in a direction parallel to crankshaft axis, and a plurality of post bone members for integrally connecting the outer ends of said cross-beam bone members in a direction of the stroke of said piston, said rigid film members being provided on lateral outer side surfaces of said longitudinal beam bone members and said post bone members.

2. An engine block according to claim 1, wherein said lower case frame and said rigid film members are formed of different materials, and said rigid film members are fixedly joined to the lateral outer side surfaces of said longitudinal beam bone members and said post bone members.

3. An engine block according to claim 2, wherein said rigid film members are adhered by an adhesive to the lateral side surfaces of the longitudinal beam bone members and the post bone members.

4. An engine block according to claim 1, wherein said lower case frame and said rigid film members are integrally formed into one piece.

5. An engine block according to claim 1, 2, 3 or 4, wherein a bottom plate bored with an oil return hole is coupled to the lower surface of said lower case.

6. An engine block according to claim 5, wherein the lower surface of said lower case is covered with an oil pan and said oil pan together with the lower case being tightened and secured to the cylinder block by a plurality of oil bolts.

7. An engine block comprising a cylinder block which constitutes a main part of the engine block, said cylinder block comprising a cylinder barrel assembly block provided with a plurality of cylinder barrels each having a cylinder bore, a skeleton-like frame of a three-dimensional latticework structure integrally joined to the outer surfaces of lateral side walls of the cylinder barrel assembly block extending along the axis of a crankshaft, and a plate-like rigid film member integrally provided on the outer surface of said skeleton-like frame, said cylinder block having a square-shaped transmission mating surface at one end thereof along the crankshaft axis, lateral surfaces of the cylinder block along the crankshaft axis being formed straight forwardly along the cylinder bore axis, the cylinder block further having a divergent bulged portion which extends from a rear part of the cylinder block in a fan-shape toward the transmission mating surface.

8. An engine block according to claim 7, wherein a lower case is integrally joined to a lower surface of said cylinder block.

9. An engine block according to claim 8, wherein the lower case is formed at one end thereof along the crankshaft axis with a transmission mating surface which is flush with the transmission mating surface of the cylinder block, lateral side surfaces of the lower case extending along the crankshaft axis formed straight forwardly in the direction of a cylinder bore axis, the lower case further having a divergent bulged portion which extends from a rear part thereof in a fan-shape toward the transmission mating surface of the lower case, and the transmission mating surfaces of the cylinder block and the lower case together forming a surface for connecting to a transmission.

10. An engine block according to claim 9, wherein bolt-inserting bosses are provided at four corners of said surface for connecting to the transmission.

11. An engine block according to claim 7, wherein said bulged portion is formed by fames and a part of said rigid film members, each said frame being formed of further bone members which are assembled into a triangular prism and said rigid film member being joined to an inclined outer surface of said frame.

12. An engine block comprising a cylinder block and a lower case joined to a lower surface of the cylinder block, a crankshaft being rotatably supported between joined surfaces of the cylinder block and the lower case, said lower case is tightened and secured to the lower surface of said cylinder block by a plurality of bolts, and an oil pan is floatingly carried on a lower surface of the lower case via resilient means.

13. An engine block comprising a cylinder block, a cylinder head integrally superposed and coupled onto a deck surface thereof and a lower case integrally joined to a lower surface of said cylinder block, said cylinder block comprising a cylinder barrel assembly block provided with a plurality of cylinder barrels each having a cylinder bore, a skeleton-like frame of a three-dimensional latticework structure integrally coupled to the outer surfaces of lateral side walls of the cylinder barrel assembly block extending parallel to the crankshaft axis, and plate-like rigid film members provided integrally on lateral outer side surfaces of the skeleton-like frame, lateral outer side surfaces of the cylinder block and the lower case extending along the crankshaft axis being formed flush with each other and substantially in parallel with the cylinder bore axis.

14. An engine block according to claim 13, wherein the lateral outer side surfaces of said cylinder block and said lower case are formed straight forwardly in the direction of the cylinder bore axis, and the lateral outer side surfaces of the cylinder head extending along the crankshaft axis are located within imaginary extended surfaces passing through the corresponding lateral outer side surfaces of the cylinder block.

15. An engine block according to claim 14, wherein said cylinder block and said lower case are formed into a generally rectangular parallelopiped integral structure.

16. An engine block according to claim 13, wherein said lower case comprises a lower case frame composed of a frame body of a three-dimensional latticework structure, and second plate-like rigid film members integrally disposed at least on lateral outer side surfaces of the lower case frame extending along the crankshaft axis.

17. An engine block comprising a cylinder block which constitutes a main part of the engine block, said cylinder block comprising a cylinder barrel assembly block provided with a plurality of cylinder barrels each having a cylinder bore, a skeleton-like frame integrally joined to the outer surfaces of lateral side walls of the cylinder barrel assembly block extending along the axis of a crankshaft, and a plate-like rigid film member provided integrally on the outer surface of the skeleton-like frame, said skeleton-like frame comprising a plurality of crossbeam bone members, longitudinal beam bone members and post bone members which are rigid and are unitarily assembled into a three-dimensional latticework structure, said cylinder barrel assembly block being formed with a coolant jacket so as to surround the cylinder bores of the cylinder barrels, said plurality of crossbeam bone members extending laterally and outwardly at intervals set therebetween in the direction of the crankshaft axis and in the direction of the cylinder bore axis from the outer surfaces of the lateral side walls of the cylinder barrel assembly block, said plurality of longitudinal beam bone members extending in the arranging direction of the cylinder barrels with spacings set therebetween in the direction of the cylinder bore axis and integrally joining said crossbeam bone members in the direction of the crankshaft axis, and said plurality of post bone members extending vertically with spacings set therebetween in the direction of the crankshaft axis and integrally joining the crossbeam bone members in the direction of the cylinder bore axis.

18. An engine block according to claim 17, wherein said cylinder barrel assembly block is formed with a coolant jacket so as to surround the cylinder bores of the cylinder barrels.

19. An engine block according to claim 17, wherein a fluid passage is disposed in the skeleton-like frame.

20. An engine block comprising a cylinder block which constitutes a main part of the engine block, said cylinder block comprising a cylinder barrel assembly block provided with a plurality of cylinder barrels each having a cylinder bore, a skeleton-like frame integrally joined to the outer surfaces of left and right side walls of the cylinder barrel assembly block along the axis of a crankshaft, and a plate-like rigid film member provided integral with the outer surface of the skeleton-like frame, said skeleton-like frame comprising a plurality of crossbeam bone members, longitudinal beam bone members and post bone members which have rigidity and are unitarily assembled into a three-dimensional latticework structure, wherein said plate-like rigid film members are directly adhered by adhesives to both the left and right outer surfaces of the skeleton-like frame of three-dimensional latticework structure.

21. An engine block according to claim 20, wherein said respective left and right rigid film members joined to the left and right outer surfaces of the skeleton-like frame are each formed from a single member.

22. An engine block comprising a cylinder block which constitutes a main part of the engine block, said cylinder block comprising a cylinder barrel assembly block provided with a plurality of cylinder barrels each having a cylinder bore, a skeleton-like frame integrally joined to the outer surfaces of left and right side walls of the cylinder barrel assembly block along the axis of a crankshaft, and a plate-like rigid film member provided integral with the outer surface of the skeleton-like frame, said skeleton-like frame comprising a plurality of crossbeam bone members, longitudinal beam bone members and post bone members which have rigidity and are unitarily assembled into a three-dimensional latticework structure, wherein said plurality of crossbeam bone members extend laterally and outwardly at intervals in the direction of the crankshaft axis and the cylinder bore axis from the outer surfaces of the left and right side walls of the cylinder barrel assembly block, said plurality of longitudinal beam bone members extend in the arranging direction of the cylinder barrels spaced apart from each other in the direction of the cylinder bore axis and integrally joining said crossbeam bone members in the direction of the crankshaft axis, and said plurality of post bone members extend vertically in spaced apart relationship from each other in the direction of the crankshaft axis and integrally join the crossbeam bone members in the direction of the cylinder bore axis.

23. An engine block according to claim 17, 22 or 20, wherein a part of said skeleton-like frame is formed with a fluid passage.

24. An engine block according to claim 23, wherein said fluid passage comprises a passage through which flows cooling water for cooling heated parts of the engine.

25. An engine block according to claim 23, wherein said fluid passage comprises an oil gallery through which flows lubricating oil for lubricating parts to be lubricated of the engine.

26. An engine block according to claim 17, 22 or 20 wherein a reinforcing member is provided for reinforcing the skeleton-like frame, and a fluid passage is formed in at least a part of the reinforcing member.

27. An engine block according to claim 26, wherein said fluid passage comprises an oil gallery through which flows lubricating oil for lubricating parts to be lubricated of the engine.

28. An engine block according to claim 26, wherein said fluid passage comprises a passage through which flows cooling water for cooling heated parts of the engine.

29. An engine block according to claim 17, 22 or 20, wherein said plurality of crossbeam bone members and post bone members are positioned on extensions of opposite end walls located in the direction of the crankshaft axis of the cylinder barrel assembly block and of boundary walls located between the adjacent cylinder bores, and wherein an upper half portion of a bearing for supporting an upper half portion of the crankshaft is provided under the projection plane formed by the crossbeam bone members and post bone members located on said extensions.

30. An engine block according to claim 6, 22 or 20 wherein the outer surface of said skeleton-like frame is formed to extend substantially parallel with the cylinder bore axis of the cylinder barrel assembly block and said plate-like rigid film member is provided integral with the outer surface.

* * * * *